US006488194B1

(12) United States Patent
Couturier

(10) Patent No.: US 6,488,194 B1
(45) Date of Patent: Dec. 3, 2002

(54) VACUUM TIMING DEVICE AND METHOD FOR PRODUCING THE SAME

(75) Inventor: Dennis P. Couturier, Washburn, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 0 days.

(21) Appl. No.: 09/650,887

(22) Filed: Aug. 30, 2000

(51) Int. Cl.[7] ..... B65H 20/00; B65H 5/04
(52) U.S. Cl. ..... 226/95; 271/276
(58) Field of Search ..... 226/95; 271/112, 271/276

(56) References Cited

U.S. PATENT DOCUMENTS

| | | | | | |
|---|---|---|---|---|---|
| 1,053,914 | A | | 2/1913 | Hudson | |
| 2,008,402 | A | * | 7/1935 | Regan | 226/95 |
| 2,631,846 | A | | 3/1953 | Sabee | |
| 2,929,624 | A | | 3/1960 | Brooker | |
| 3,163,413 | A | | 12/1964 | Franke et al. | |
| 3,172,321 | A | * | 3/1965 | Schrader | 226/95 X |
| 3,489,406 | A | | 1/1970 | Nystrand | |
| 3,572,681 | A | | 3/1971 | Nystrand | |
| 3,709,077 | A | | 1/1973 | Trogan et al. | |
| 3,784,188 | A | | 1/1974 | De Ligt | |
| 3,942,788 | A | * | 3/1976 | Boyle | 271/276 |
| 4,070,014 | A | | 1/1978 | Takahashi | |
| 4,159,872 | A | * | 7/1979 | Klann | 226/95 X |
| 4,254,947 | A | | 3/1981 | Trogan | |
| 4,270,744 | A | | 6/1981 | Trogan | |
| 4,328,626 | A | * | 5/1982 | Leitner | 226/95 X |
| 4,332,583 | A | | 6/1982 | Stemmler et al. | |
| 4,396,336 | A | | 8/1983 | Malamood | |
| 4,403,847 | A | * | 9/1983 | Chrestensen | 226/95 X |
| 4,406,650 | A | | 9/1983 | Felix | |
| 4,475,730 | A | | 10/1984 | Trogan | |
| 4,494,741 | A | | 1/1985 | Fischer et al. | |
| 4,508,527 | A | | 4/1985 | Uno et al. | |
| 4,650,447 | A | | 3/1987 | Meschi | |
| 4,673,382 | A | | 6/1987 | Buck et al. | |
| 4,770,402 | A | | 9/1988 | Couturier | |
| 4,778,441 | A | | 10/1988 | Couturier | |
| 4,909,492 | A | | 3/1990 | Biagiotti | |
| 4,998,715 | A | * | 3/1991 | Milan et al. | 271/276 |
| 5,114,062 | A | * | 5/1992 | Kuhn et al. | 226/95 |
| 5,230,456 | A | * | 7/1993 | Germann et al. | 226/95 |
| 5,358,163 | A | * | 10/1994 | Naka | 226/95 X |
| 6,250,581 | B1 | * | 6/2001 | Cramer | 226/95 X |

OTHER PUBLICATIONS

Webex, Inc. website: "Weber Vacuum Rolls" Jan. 17, 2000 http://www.webexinc. com/rolls/vacuum/vacuum.htm "Converting" Magazine, vol. 18, No. 1, Jan. 10, 2000 p. 74, "Vacuum Rolls for web control".

* cited by examiner

*Primary Examiner*—Michael R. Mansen
(74) *Attorney, Agent, or Firm*—Michael Best & Friedrich LLP

(57) ABSTRACT

A vacuum timing device for applying a vacuum on a roll includes a roll with an axis of rotation, a surface, and a surface longitudinal axis oriented in a direction substantially parallel to the axis of rotation. The device also includes at least one vacuum line running along at least a portion of the length of the roll. The device also includes a plurality of apertures defined in a surface of the roll and in fluid communication with the vacuum line. In order to alleviate angular delay of vacuum propagation, the plurality of apertures is arranged in a line that is skewed with respect to the surface longitudinal axis. Preferably, the plurality of apertures is arranged in a line that is skewed away from the direction of rotation of the roll, thereby substantially eliminating the angular propagation delay as the vacuum roll operates.

53 Claims, 9 Drawing Sheets

VACUUM TIMING DEVICE AND METHOD FOR PRODUCING THE SAME

FIELD OF THE INVENTION

The invention relates generally to vacuum assisted rolls, and more particularly to a vacuum timing device that compensates for the delay in vacuum propagation along the length of the roll.

BACKGROUND OF THE INVENTION

It is well known to utilize vacuum means to transfer webs from roll to roll or from a roll to another device such as a set of guide rods. The vacuum is selectively applied through apertures at selected circumferential locations on the rotating roll in order to hold a web of material to the roll for a desired time or along a desired path. As used herein and in the appended claims, the term "web" means any material (including without limitation paper, metal, plastic, rubber or synthetic material, fabric, etc.) which can be or is found in sheet form (including without limitation tissue, paper toweling, napkins, foils, wrapping paper, food wrap, woven and non-woven cloth or textiles, etc.). The term "web" does not indicate or imply any particular shape, size, length, width, or thickness of the material.

FIG. 1 illustrates a typical prior art vacuum roll system 10 for use in operations requiring web transfer. The prior art vacuum roll system 10 includes a roll 14 having an axis of rotation 18 and a surface 22. The surface 22 has a plurality of apertures 26 therein which are spaced longitudinally along the length of the roll 14 forming a straight row 30. Typically, there are a plurality of straight rows 30 (e.g., four rows spaced at ninety-degree angles), around the surface 22. Each row 30 is in fluid communication with a vacuum line 34. Normally, the vacuum line 34 is a bore that extends longitudinally along the length of the roll 14 just beneath the surface 22. The apertures 26 are typically drilled through to the vacuum line 34, thus providing the fluid communication between the apertures 26 and the line 34. The line 34 has an vacuum inlet 38 in at least one end of the roll 14, the purpose of which will be described below.

In prior art devices, a rotary vacuum valve 42 is usually coaxially coupled to the roll 14 at one end and is fixed against rotation. The valve 42 is connected to a vacuum source (not shown) at a valve inlet 50. The valve 42 also includes an arcuate groove 54 in the end adjacent the roll 14. The arcuate groove 54 is in fluid communication with the valve inlet 50. The arcuate groove 54 is spaced radially from the axis of rotation 18 such that it can be in fluid communication with the line 34. In operation, the vacuum source creates a vacuum that enters the valve 42 at the valve inlet 50. As the roll 14 rotates to angular position A, the vacuum inlet 38 of the line 34 is adjacent the arcuate groove 54. The vacuum therefore enters the vacuum inlet 38 and propagates longitudinally along the length of the line 34. As the vacuum propagates, the apertures 26 experience the vacuum which is then applied to the web, holding the web to the surface 22 of the roll 14. As the roll 14 rotates to angular position B, the fluid communication between the vacuum inlet 38 and the arcuate groove 54 is blocked, thereby cutting off the vacuum supply to the line 34 and apertures 26. The line 34 is often vented in a conventional manner to remove the vacuum inside the line 34 quickly. By changing the length of arcuate groove 54, the timing of vacuum application and removal can be modified to suit a specific application. The description of the prior art vacuum valve 42 is only presented by way of illustration. Other types of vacuum valves (not shown) are also commonly used in prior art vacuum roll systems 10.

Surface speeds of the roll 14 typically vary depending upon application, but can reach 600 feet per minute or higher. Vacuum propagates through each line 34 at the speed of sound. Therefore, for long rolls 14 rotating at such high speeds, it is common to encounter angular delay in the propagation of the vacuum along the lines 34. For example, when roll 14 reaches angular position A, and the vacuum is introduced into the vacuum inlet 38, it is common in longer rolls 14 for the vacuum to reach the apertures 26 closest to the vacuum inlet 38 almost instantaneously while reaching the apertures 26 located farthest from the vacuum inlet 38 at a measurably later time. Often, the vacuum will not reach the apertures 26 located farthest from the vacuum inlet 38 until the roll has rotated to an angular position A+ΔA. When this angular delay occurs, the portion of the web (not shown) closest to the vacuum inlet 38 will experience the vacuum before the portion of the web farthest from the vacuum inlet 38. This can cause binding, inadequate web retention, or misalignment of the web, resulting in flawed product, jams, misfeeds, wrinkling and/or even line shut-down.

Angular delay will also be experienced when vacuum is removed from the lines 34. For example, when roll 14 reaches angular position B, and the communication between the vacuum inlet 38 and the arcuate groove 54 is blocked, it is common in longer rolls 14 for the vacuum to remain in the apertures 26 located farthest from the inlet opening longer than the vacuum remains in the apertures 26 located nearest to the vacuum inlet 38. Thus, the vacuum will not be removed from the apertures 26 located farthest from the vacuum inlet 38 until the roll has rotated to an angular position B+ΔB. When this occurs, the portion of the web closest to the vacuum inlet 38 will be released from the surface 22 earlier than the portion of the web farthest from the vacuum inlet 38. Again, this can cause the above-mentioned problems. FIG. 2 shows an exaggerated profile of the angular delay just described. The profile illustrates the angular location of the apertures at the actual point of vacuum removal.

Attempts to alleviate the problem of angular delay have led to the use of two rotary vacuum valves 42, one on each end of roll 14. Each valve 42 has its own valve inlet 50 and arcuate groove 54. Each arcuate groove 54 communicates with an adjacent vacuum inlet 38 at either end of the line 34. This configuration has reduced angular delay problems associated with long rolls 14 in that the vacuum need only propagate half the length of the roll 14. However, the high rotational speed demanded in many applications still results in angular delay near the center of the roll 14. Furthermore, the use of two vacuum valves 42 adds more parts to the vacuum roll assembly 10 which increases the cost, complexity and maintenance required of the system.

In light of the problems and limitations of the prior art described above, a need exists for a vacuum timing device that can account and compensate for angular delay of vacuum in a rotating vacuum roll, can perform such compensation at a variety of roll rotational speeds, presents a simple and inexpensive solution to the angular delay problems described above and permits the use of a vacuum roll at high speeds without the angular delay experienced in prior art vacuum rolls. Each preferred embodiment of the present invention achieves one or more of these results.

SUMMARY OF THE INVENTION

The invention provides a vacuum timing device for applying a vacuum on a roll. The vacuum timing device includes a roll with an axis of rotation, a surface, and a surface longitudinal axis that is oriented in a direction substantially parallel to the axis of rotation. The device also includes at least one vacuum inlet communicating with at least one vacuum line running along at least a portion of the length of the roll. The device also includes a plurality of apertures defined in a surface of the roll and in fluid communication with the vacuum line. In order to alleviate angular delay of vacuum propagation, the plurality of apertures is arranged in a line that is skewed with respect to the surface longitudinal axis. Preferably, the plurality of apertures is arranged in a line that is skewed away from the direction of rotation of the roll, thereby substantially eliminating the angular propagation delay as the vacuum roll operates.

For longer rolls, the device can include two or more pluralities of apertures, each being in fluid communication with a respective vacuum line. Using two pluralities of apertures reduces the vacuum propagation distance, thereby reducing the propagation delay. When these long rolls operate at high speeds, however, delay often still exists. Therefore, each plurality of apertures is arranged in a line that is skewed with respect to the surface longitudinal axis to compensate for the remaining angular delay.

The pluralities of apertures can be formed directly in the surface of the roll, or alternatively, can be formed in one or more vacuum members that are coupled to the roll. Rolls having the apertures formed directly in the surface are preferable when the roll will rotate in the same direction and with substantially the same rotational speed over its lifetime. Once the direction of rotation and the rotational speed are known, the plurality of apertures can be machined directly into the surface with the appropriate skew. In the event the production line is changed and the direction or speed of rotation is modified, a different roll having a different skew configuration could be substituted, or portions of a roll could be replaced.

On the other hand, rolls that incorporate at least one vacuum member provide greater flexibility in that the vacuum member is preferably movable. The vacuum member can be selectively positioned to accommodate the direction of roll rotation and any number of rotational speeds. Most preferably, the vacuum member can be selectively positioned to accommodate both possible directions of roll rotation. The vacuum member can be moved with respect to the surface longitudinal axis either manually or automatically in any suitable manner. Preferably, the vacuum member is pivoted either about its end or a center portion of the vacuum member. When the vacuum member is moved automatically via a suitable actuating device, it is preferable to electronically (via computer or electronic switching controls) or mechanically link the actuating device to the roll to allow for automatic adjustment of the vacuum member proportional to the rotational speed of the roll. When more than one vacuum member is used, the vacuum members preferably operate in substantially the same manner.

When a vacuum member is used, the preferred configuration includes a roll having a longitudinal gap in the surface. The gap receives and accommodates at least a portion of the vacuum member. The plurality of apertures are preferably formed in a central portion of the vacuum member and communicate with the vacuum line in the roll. Preferably, the vacuum member also includes tab portions that extend from either side of the central portion. The tab portions are preferably received in respective grooves that are located radially in the roll. Preferably, the location of the grooves is such that when the vacuum member is inserted, the plurality of apertures in the central portion are at substantially the same radial distance from the axis of rotation as the surface. Alternatively, the location of the groove can be varied so that the plurality of apertures is slightly recessed or raised from the surface of the roll.

The grooves and gap are preferably appropriately sized to permit movement of the vacuum member relative to the roll. The vacuum member is preferably made from a flexible material so that as the vacuum member is pivoted it wraps partially around the roll, thereby skewing the plurality of apertures with respect to the surface longitudinal axis. The vacuum line should be large enough to accommodate preferably the entire range of movement available to the plurality of apertures. When more than one vacuum member is used, the vacuum members are preferably configured in substantially the same manner.

More information and a better understanding of the present invention can be achieved by reference to the following drawings and detailed description.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
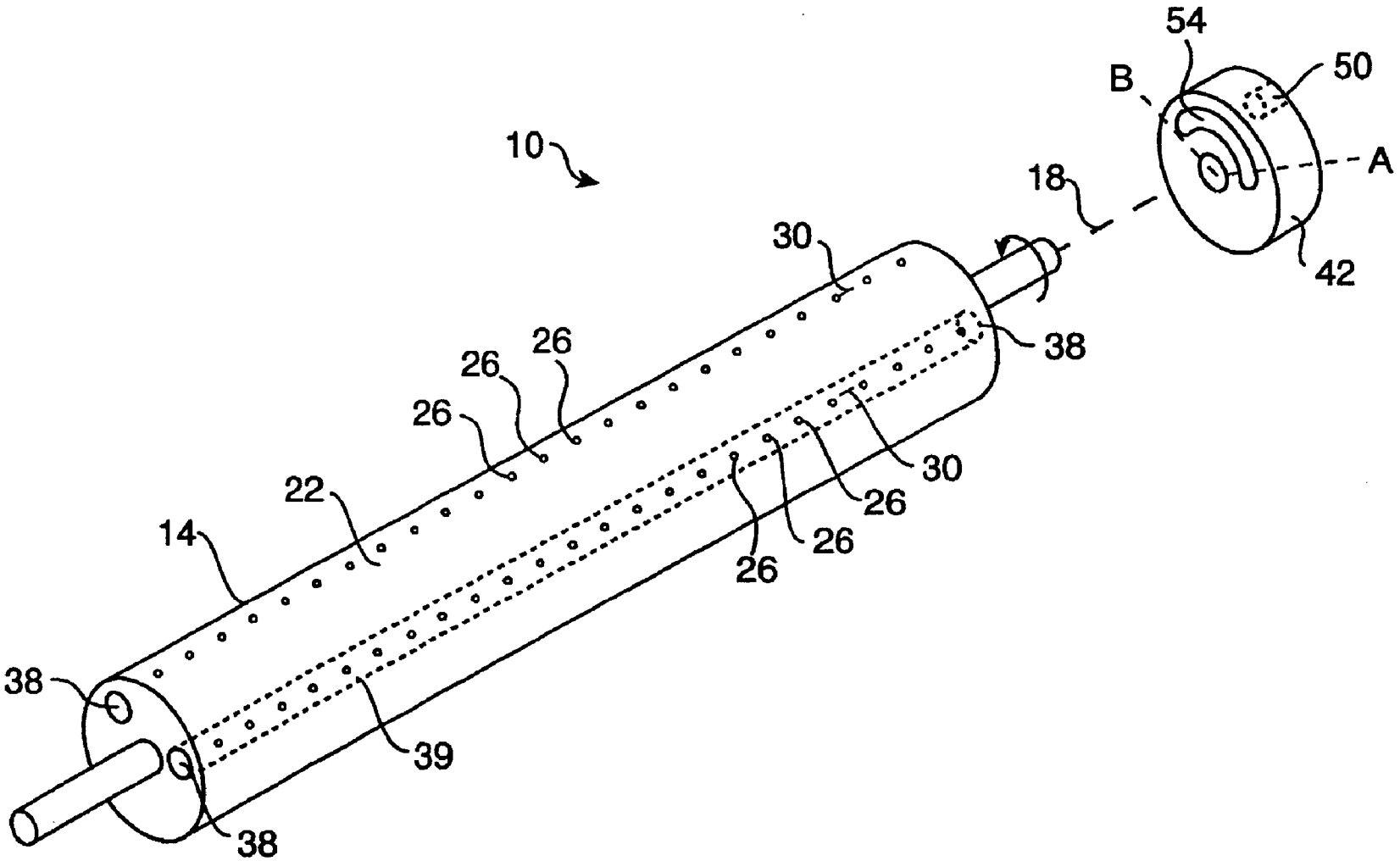
FIG. 1 PRIOR ART
FIG. 1 is a perspective view of a prior art vacuum roll system.
Figure 2:
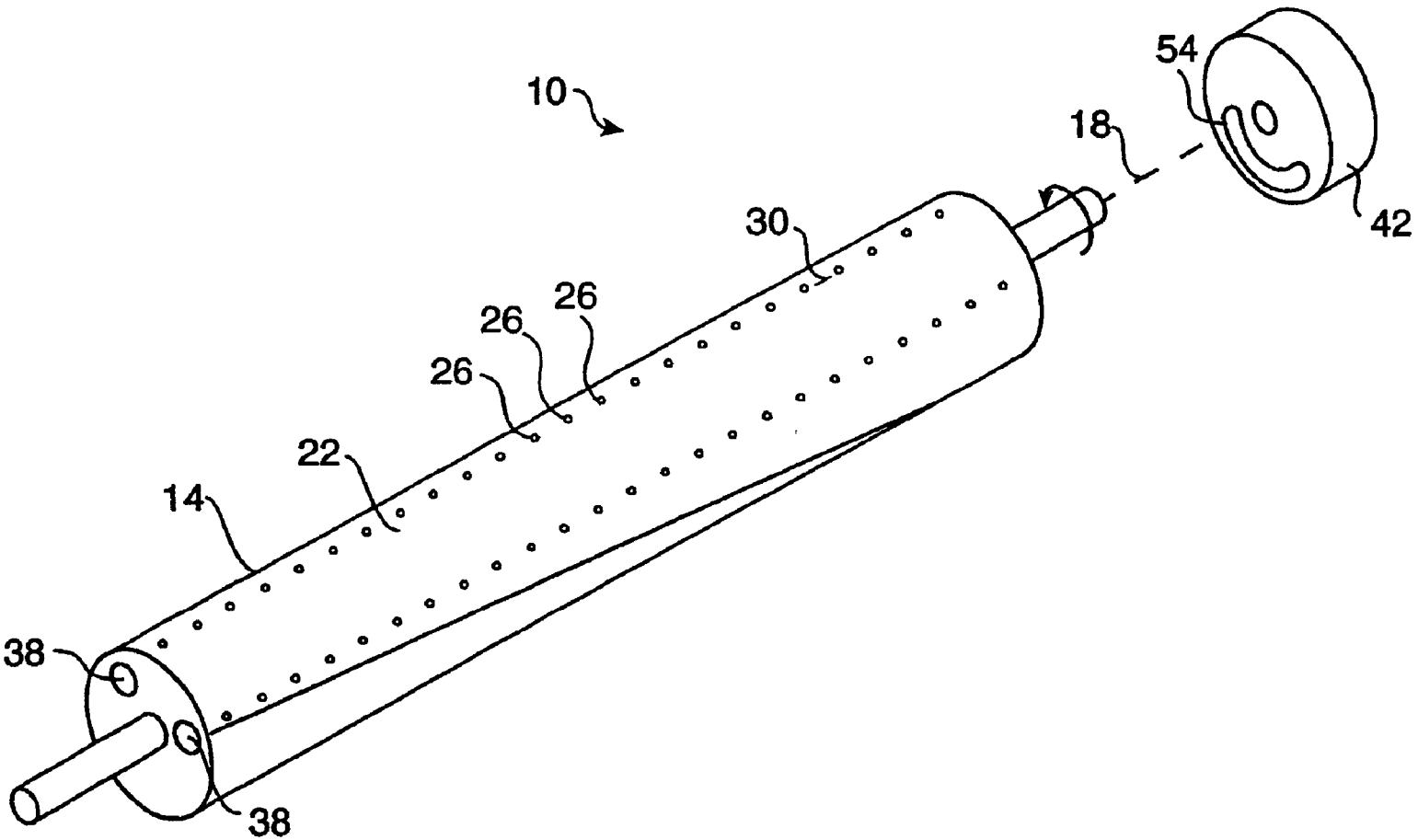
FIG. 2 PRIOR ART
FIG. 2 is a perspective view of a prior art vacuum roll illustrating an angular delay profile.
Figure 3:
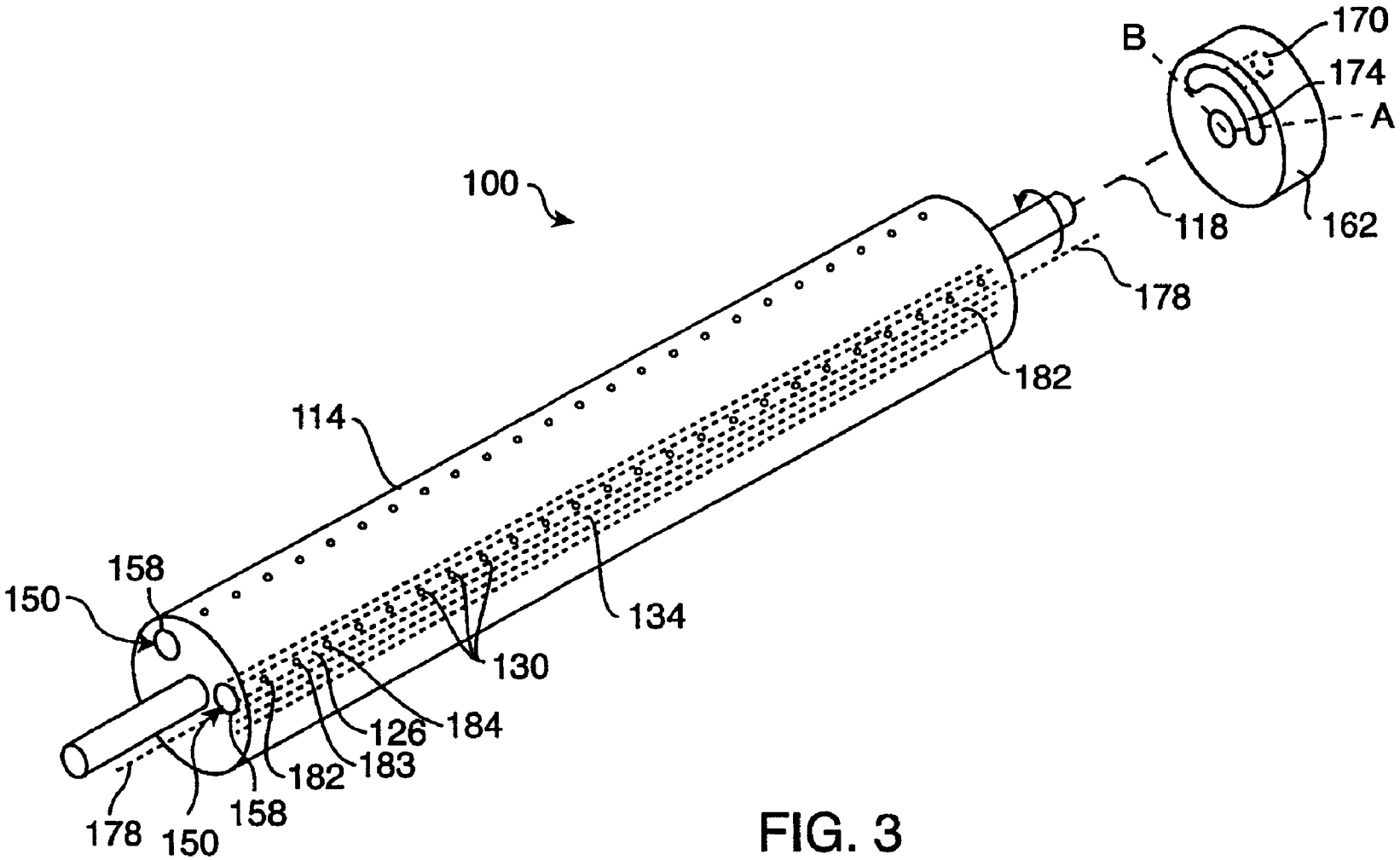
FIG. 3 is a perspective view of a vacuum roll according to a first preferred embodiment of the present invention.
Figure 5:
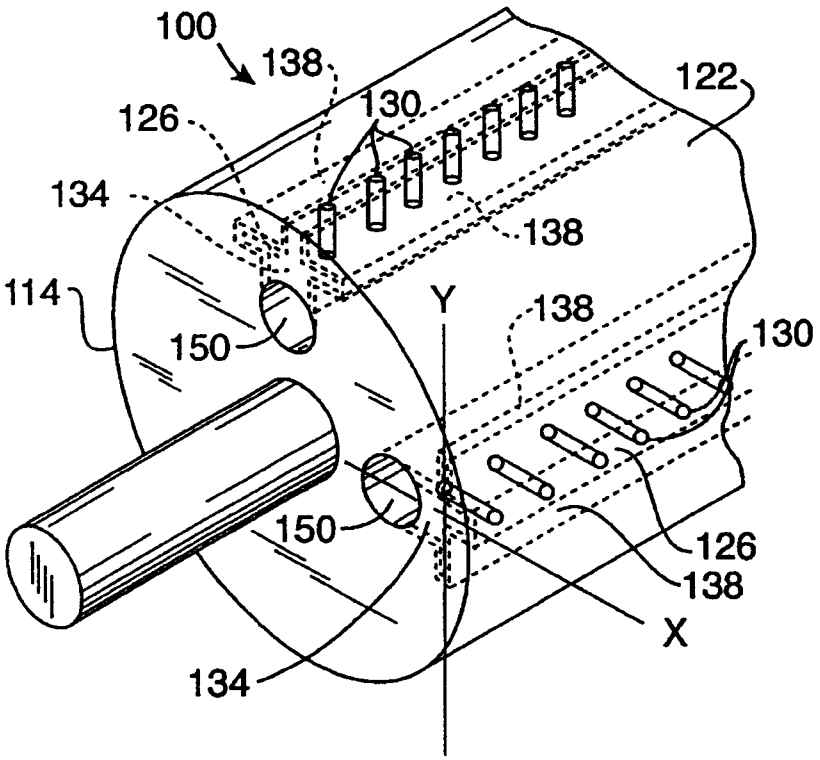
FIG. 5 is a detail perspective view of the vacuum roll shown in FIGS. 3 and 4.
Figure 4:
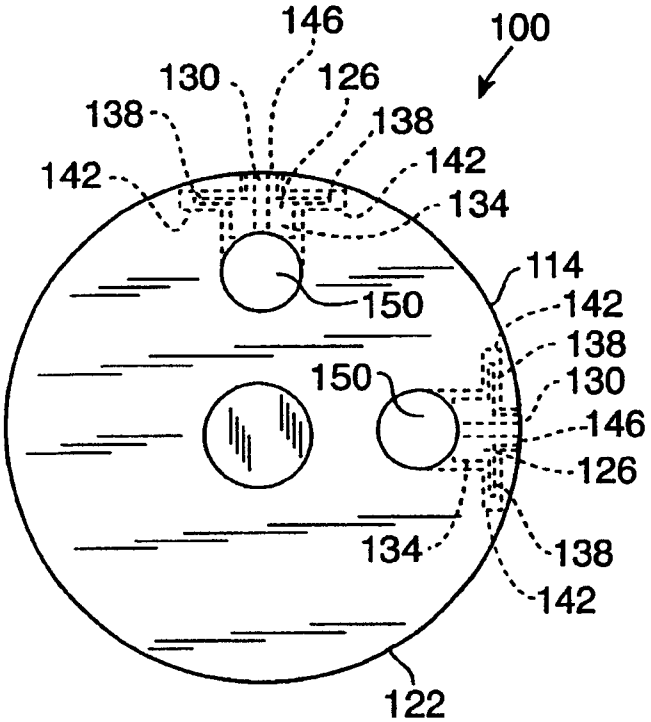
FIG. 4 is an end view of the vacuum roll shown in FIG. 3.

The present invention can be used to reduce or alleviate angular delay of rotating vacuum systems and the problems associated therewith. FIGS. 3, 4 and 5 illustrate a vacuum roll system 100 of the present invention. It should be noted that the present invention is not limited only to web transfer operations, and can be used in conjunction with any operation in which vacuum or forced air is applied to a web material, such as in perforation, embossing, folding, cutoff or other types of rolls and for controlling actuation of blades, bars, inking or gluing devices, or virtually any other type of element or apparatus on a roll which is to be selectively operated or actuated by vacuum.

The vacuum roll system 100 includes a roll 114 having an axis of rotation 118 and a surface 122. It should be noted that the surface 122 need not be smooth or homogenous, but rather can include raised portions, recessed portions, or can be comprised of a plurality of multiple surface elements (e.g., panels or plates coupled together to form the surface 122). A vacuum member 126 is coupled to the roll 114 and includes a plurality of apertures 130 defined in the vacuum member 126 and extending therethrough. The apertures can be any shape desired, but are preferably round as shown in the figures. Preferably, the apertures 130 extend through a central portion 134 of the vacuum member 126. As best seen in FIGS. 4 and 5, tab portions 138 preferably extend substantially perpendicularly from the central portion 134 giving the vacuum member 126 a T-shaped cross section about its X-axis. It is important to note that although such a vacuum member shape is preferred, the vacuum member 126 could be of any other cross-section or form suitable for allowing coupling of the vacuum member 126 to the roll 14. For example, the vacuum member 126 could have an H-shaped cross-section about its Y-axis by including a second set of tab portions (not shown) closer to the plurality of apertures 130. Alternatively, tab portions 138 could be replaced by intermittent dowels or other protrusions (not shown) extending from the vacuum member 126 into recesses, apertures, and the like in the roll 114. The vacuum member 126 is preferably made of any suitably flexible material such as metal (insofar as the dimensions and length of the vacuum member 126 are concerned, many metals can be considered to be "flexible" for purposes of the present invention), plastic or rubber and can be formed by any suitable manufacturing process including but not limited to extrusion, injection molding or other machining processes.

As best seen in FIG. 4, the vacuum member 126 is preferably coupled to the roll 114 by inserting the tab portions 138 into opposite ends of a groove 142 depending from a longitudinal gap 146 in the roll 114 and sliding the first vacuum member 126 longitudinally along the length of groove 142. Alternative configurations of the vacuum member 126 can necessitate alternative methods of coupling the vacuum member 126 to the roll 114, which are not outside the scope of this invention, such as assembling the vacuum member 126 after insertion into the roll 114, assembling parts of the roll 114 after insertion of the vacuum member 126, etc. The longitudinal gap 146 preferably receives the central portion 134 of the vacuum member 126. Groove 142 is preferably located at a distance below the surface 122 so that the plurality of apertures 130 are located at substantially the same radial distance from the axis of rotation 118 as the surface 122. However, the groove 142 can be located such that the plurality of apertures 130 are recessed in, or raised from, the surface 122. The width of the groove 142 and the longitudinal gap 146 is greater than the width of the tab portions 138 and the central portion 134 respectively, for reasons that will be explained below.

Figure 6:
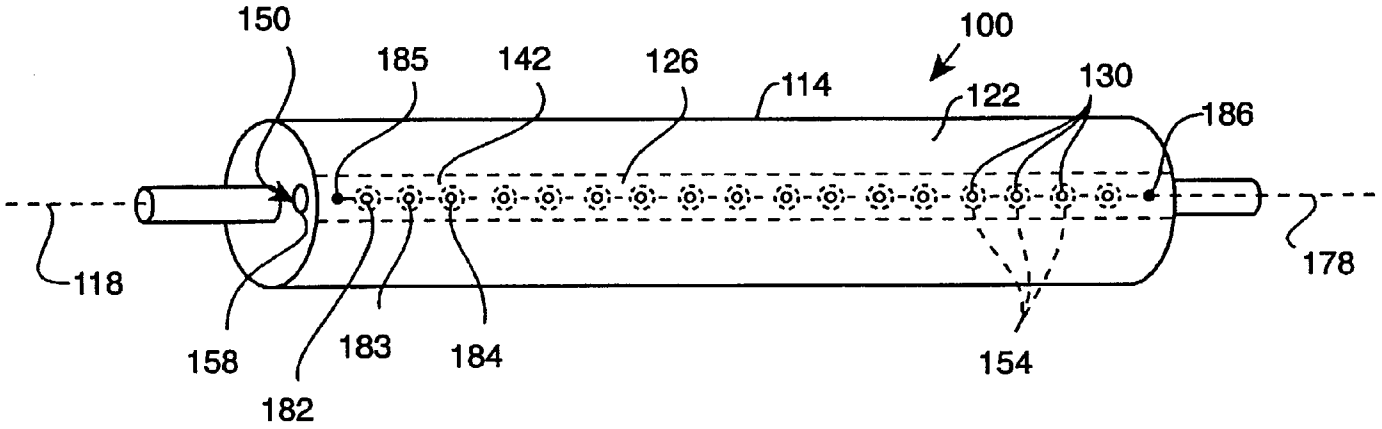
FIG. 6 is a perspective view of a vacuum roll having an alternative vacuum line configuration.

A vacuum line 150 is located radially below the groove 142 and in one preferred embodiment of the present invention (shown in FIGS. 4 and 5) intersects the groove such that the plurality of apertures 130 in the central portion 134 are in fluid communication with the vacuum line 150. Preferably, the vacuum line 150 is defined by a bore or elongated chamber running longitudinally along the length of the roll 114, but this need not be the case. As shown in FIGS. 6–10, the vacuum line 150 could instead be defined by a bore that does not intersect groove 142, but rather runs along the roll at a radial distance below groove 142 and is in fluid communication with the groove 142 via a plurality of apertures running from the vacuum line 150 to each of the apertures 130 in the vacuum member. With particular reference to FIG. 6, these line openings 154 could be machined in the groove 142 such that the openings 154 correspond to the locations of the plurality of apertures 130 and provide fluid communication between the plurality of apertures 130 and the vacuum line 150. Because the line openings 154 are larger than the apertures 130 in the preferred embodiment shown in FIGS. 3–10 (and would not therefore be visible in the figures), the line openings 154 are shown in phantom while the plurality of apertures 130 are shown in solid lines. A vacuum inlet 158 is preferably located at one end of the vacuum line 150.

In a less preferred embodiment of the present invention, the line openings 154 (if employed as described above) can be smaller than the plurality of apertures 130. In such a case, the apertures 130 are preferably sufficiently large to maintain fluid communication with the openings 154 in the entire range of positions of the vacuum members 126. For this purpose, the apertures 130 can have a larger diameter, can be elongated in shape (generally in a circumferential direction with respect to the roll surface 122), and the like.

A rotary vacuum valve 162 is preferably coupled to the roll 114 at one end and shares the axis of rotation 118, but is fixed against rotation. The rotary vacuum valve 162 is connected to a vacuum source (not shown) at the valve inlet 170. The rotary vacuum valve 162 also includes an arcuate groove 174 in the end adjacent the roll 114. The arcuate groove 174 is in fluid communication with the valve inlet 170. The arcuate groove 174 is spaced radially from the axis of rotation 118 such that it can be in fluid communication with the vacuum inlet 158 and the vacuum line 150. Once again, the rotary vacuum valve 162 is only one type of valve suitable for use with the preferred embodiment of the invention and is described and illustrated herein by way of example only. Other well-known valve assemblies, which may be located at different locations on the roll, can also be used.

In operation of the preferred embodiment described above, the vacuum source creates a vacuum that enters the rotary vacuum valve 162 at the valve inlet 170. With reference to FIG. 3, as the roll 114 rotates to angular position A, the vacuum inlet 158 of the vacuum line 150 is in fluid communication with the arcuate groove 174. The vacuum enters the vacuum inlet 158 and propagates longitudinally along the length of the vacuum line 150. As the vacuum propagates, the plurality of apertures 130 experience the vacuum which is then applied to a web adjacent the roll 114, thereby holding the web to the surface 122 of the roll 114.

As the roll 114 rotates through angular position B, the fluid communication between the vacuum inlet 158 and the arcuate groove 174 is blocked, and the vacuum line 150 is preferably vented in any conventional manner to remove the vacuum in the vacuum line 150. By changing the angular length of arcuate groove 174, the timing of vacuum application and removal can be modified to suit the specific application.

To address the problem of angular delay described earlier, the vacuum member 126 is movable, and more preferably is pivotable, with respect to the surface 122 of the roll 114. For purposes of explanation, a surface longitudinal axis 178 is defined as an axis running longitudinally along the surface 122 of the roll 114 and oriented in a direction substantially parallel to the axis of rotation 118. The surface longitudinal axis 178 preferably intersects an end or first aperture 182 of the plurality of apertures 130, which is preferably the aperture closest to the vacuum inlet 158. Note that the vacuum valve 162 is shown in FIG. 3 on the right side of the roll 114 for purposes of illustration only. In FIGS. 6–10, the vacuum valve 162 (not shown) would instead be located on the left side of the roll 114. The vacuum member 126 pivots with respect to the surface longitudinal axis 178 inside groove 142 and longitudinal gap 146, which are wider than the tab portions 138 and central portion 134 respectively, to allow for such pivoting.

When the vacuum member 126 is pivoted, the plurality of apertures 130 are arranged in a line that is skewed with respect to the surface longitudinal axis 178. As used herein and in the appended claims, the term "line" means a real or imaginary mark defining a shape or representing a contour. The term "line" does not indicate or imply any particular shape, contour, size, length, or width of the line defined by the arrangement of apertures 130. For example, the term "line," as used herein, includes both straight and curved arrangements of the apertures 130. As used herein and in the appended claims, the term "skewed" means turned or placed at an angle, given a bias, or distorted. The term "skewed" does not indicate or imply any particular direction, amount or angle, and does not indicate or imply any consistency or lack of consistency in direction, amount or angle.

To state the configuration in other words, when the vacuum member 126 is pivoted from a position substantially parallel to the vacuum roll axis 118, the line defined by the plurality of apertures 130 is not parallel to the surface longitudinal axis 178. In yet other words, the vacuum member 126 includes the first aperture 182 and a second aperture 183 in fluid communication with the first aperture 182. The fluid communication is established via the vacuum line 150. When the vacuum member 126 is pivoted, the first and second apertures 182, 183 define endpoints of a line that is skewed with respect to the surface longitudinal axis 178. The vacuum member 126 can also include a third aperture 184 in fluid communication with the first and second apertures 182, 183 as shown in the figures. When the vacuum member 126 is pivoted, the second and third apertures 183, 184 define endpoints of a line that is also skewed with respect to the surface longitudinal axis. This line defined by the second and third apertures 183, 184 can be aligned with the line defined by the first and second apertures 182, 183 as is the case in the illustrated preferred embodiment, or can be skewed with respect thereto (where the plurality of apertures 130 are positioned on the vacuum member in a line that is not straight).

To compensate for angular delay in operation of the present invention, the vacuum member 126 is pivoted so that the line defined by the plurality of apertures 130 is skewed in a direction away from the direction of rotation of the roll 114. As used herein and in the appended claims, the term "away from" means in a direction wherein the aperture closest to the vacuum inlet 158 leads at least one of the remaining plurality of apertures 130 as the roll 114 rotates. Simply stated, at least one aperture of the plurality of apertures 130 will be at the leading edge of rotation, while another aperture of the plurality of apertures 130, which is further away from the vacuum inlet 158, will trail the leading edge of rotation. In yet other words, the plurality of apertures 130 is skewed so that as the roll 114 rotates, at least one aperture that is further away from the vacuum inlet 158 lags behind at least one aperture that is closer to the vacuum inlet 158. In the illustrated preferred embodiment, the roll 114 is capable of rotation in either direction and the vacuum member 126 can be pivoted, and therefore skewed, in either direction. To eliminate angular delay, however, the vacuum member 126 should be pivoted so that the line defined by the plurality of apertures 130 is skewed in a direction away from the direction of rotation.

Figure 7:
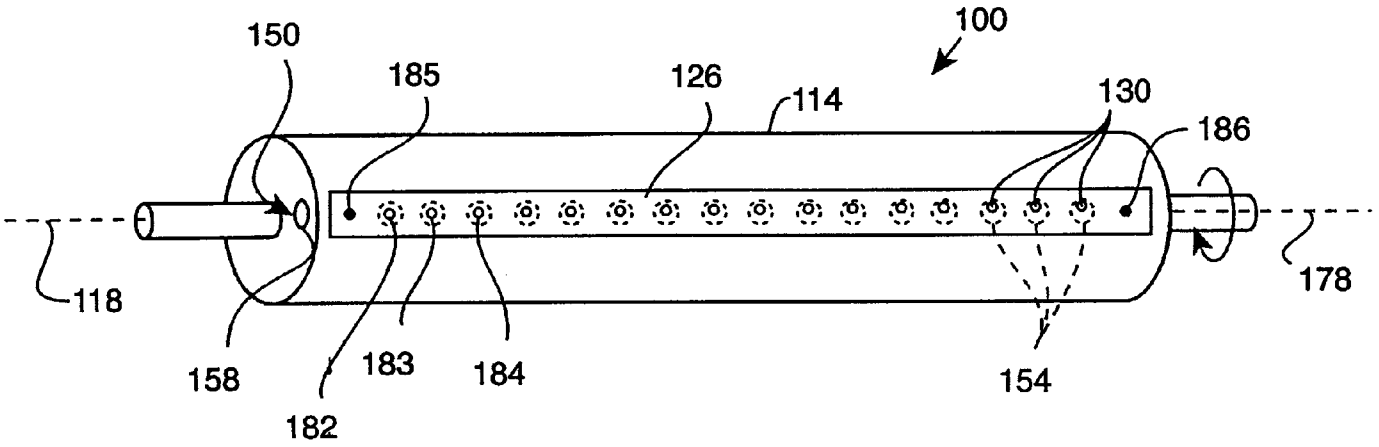
FIG. 7 is a perspective view of the vacuum roll and vacuum member shown in FIGS. 3–5, showing the vacuum member pivoted manually about the end of the vacuum roll.

The vacuum member 126 can be pivoted either manually or automatically, and can be pivoted about a number of possible pivot points. For example, FIG. 7 shows a vacuum member 126 that is manually pivotable about a pivot point 185 located near one end of the roll 114. It is important to note that pivot point 185 could be located near the opposite end of the roll 114 without deviating from the invention. The user can pivot he first vacuum member 126 relative to the surface longitudinal axis 178 in a direction and at a degree suitable for the direction of of rotation and speed of rotation demanded by the specific application. Securing element 186 is used to hold or lock the first vacuum member 126 in a selected pivot position. Securing element 186 can be any suitable device for fastening the vacuum member 126 into position on the roll 114 including, but not limited to, a screw, a set screw, a pin, a bolt, a clamp or any other conventional device capable of releasably securing one element to another. The securing element 186 is preferably located near the end of the roll 114 opposite the pivot point 185, but can be located virtually anywhere along the vacuum member 126.

Figure 8:
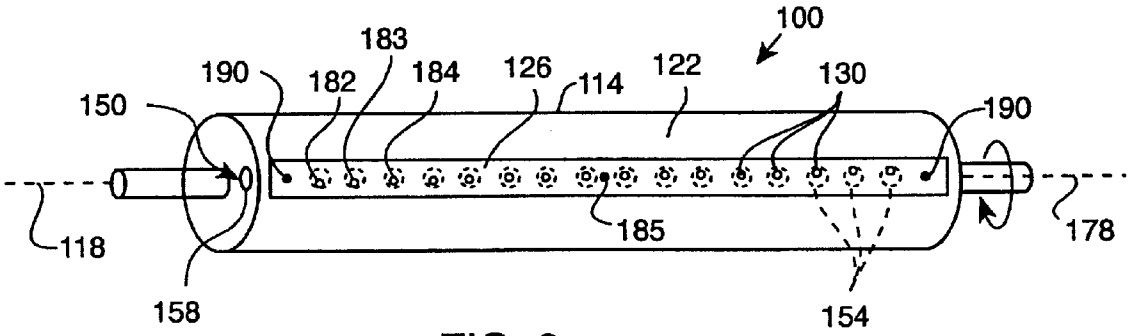
FIG. 8 is a perspective view of the vacuum roll and vacuum member shown in FIGS. 3–5, showing the vacuum member pivoted manually about the central portion of the vacuum roll.

FIG. 8 shows a vacuum member 126 that is manually pivotable about a pivot point 185 located at a central portion of the roll 114. Again, the user can pivot the vacuum member 126 relative to the surface longitudinal axis 178 in a direction and at a degree suitable for the direction of rotation and speed of rotation demanded by the specific application. Securing elements 190, preferably located near or at both ends of roll 114 are used to hold or lock the vacuum member 126 in the selected pivot position. Securing elements 190 can be any suitable device for fastening the vacuum member 126 into position on the roll 114 including, but not limited to, a screw, a set screw, a pin, a bolt, a clamp or any other conventional device capable of releasably securing one element to another, The securing elements 190 are preferably located near each end of the roll 114, but can be located virtually anywhere along the vacuum member 126. Furthermore, in either embodiment shown in FIGS. 7 and 8, any number of securing elements can be used as desired.

Figure 9:
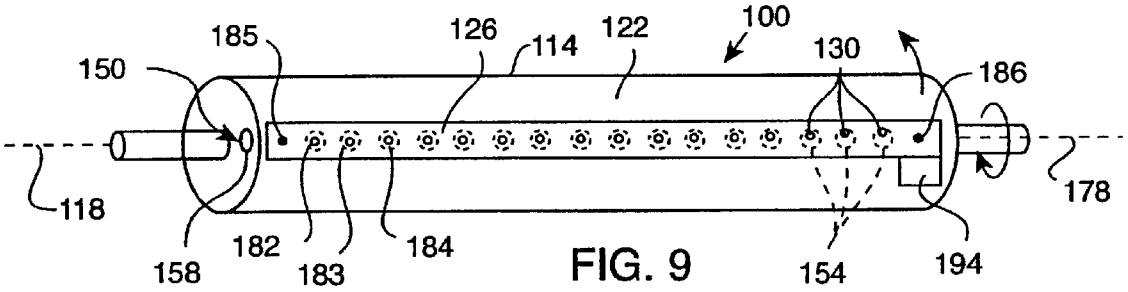
FIG. 9 is a perspective view of the vacuum roll and vacuum member shown in FIGS. 3–5, showing the vacuum member pivoted automatically about the end of the vacuum roll.
Figure 10:
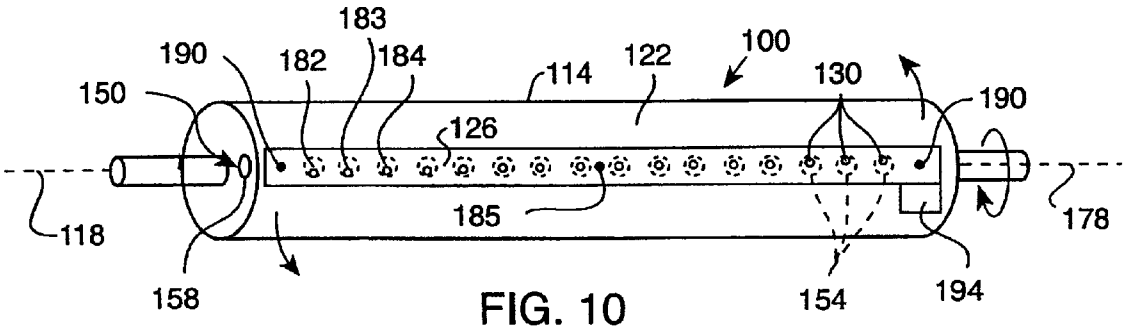
FIG. 10 is a perspective view of the vacuum roll and vacuum member shown in FIGS. 3–5, showing the vacuum member pivoted automatically about the central portion of the vacuum roll.

The embodiments illustrated in FIGS. 9 and 10 are substantially the same as the embodiments illustrated in FIGS. 7 and 8 with the exception that a vacuum member 126 is pivoted automatically using a positioning device 194. FIG. 9 illustrates the end-pivot configuration while FIG. 10 illustrates the central portion-pivot configuration, both of which were described above with respect to FIGS. 7 and 8. The positioning device 194 can take the form of any device or mechanism suitable for pivoting the vacuum member 126 including, but not limited to, a cable, rack and pinion, levers and rods, electric motors, pneumatic cylinders, electromagnets or solenoids mounted upon the roll 114 or within a recess or receptacle in the roll 114. For example, an electromagnet (not shown) could be placed on either side of the vacuum member 126 inside the roll 114 such that when energized, the vacuum member 126 would be attracted to, and pivot towards, the electromagnet. Alternatively, a plunger of an electric solenoid (not shown) could be used as the positioning device 194 to pivot the vacuum member 126 upon activation of the solenoid. The positioning device 194 also preferably holds the vacuum member 126 in the pivoted position until further adjustment is required. Furthermore, the positioning device 194 could be electronically or mechanically linked (via computer or electronic or manual switching controls) to the roll 114 to allow for automatic adjustment of the vacuum member 126 that is proportional to the rotational speed of the roll 114.

Regardless of how pivoted, the vacuum member 126 is sufficiently flexible to wrap around the roll 114 as it pivots. This insures that the plurality of apertures 130 as well as the central portion 134 do not extend radially outward beyond the surface 122 enough to interrupt or affect vacuum applied to the apertures 130. Furthermore, it is important that the vacuum line 150 be sized such that fluid communication will remain between the vacuum line 150 and each of the plurality of apertures 130, regardless of the direction or degree of pivot. In other words, the vacuum line 150 must be designed to allow fluid communication with the plurality of apertures 130 over the entire range through which the apertures 130 can pivot. This can be achieved by designing the vacuum line 150 as a bore having a sufficiently large diameter, by designing the vacuum openings 154 with diameters sufficiently large to encompass the entire range of motion through which the corresponding apertures 130 can pivot, or by designing the apertures 130 with diameters sufficiently large to remain in fluid communication with the vacuum openings 154 throughout the range of motion of the apertures 130. Care should be taken, however, that the vacuum line 150 and/or vacuum openings 154 do not permit vacuum leakage from the roll 114 during operation of the vacuum roll system 100, regardless of the positioning of the vacuum member 126.

Figure 11:
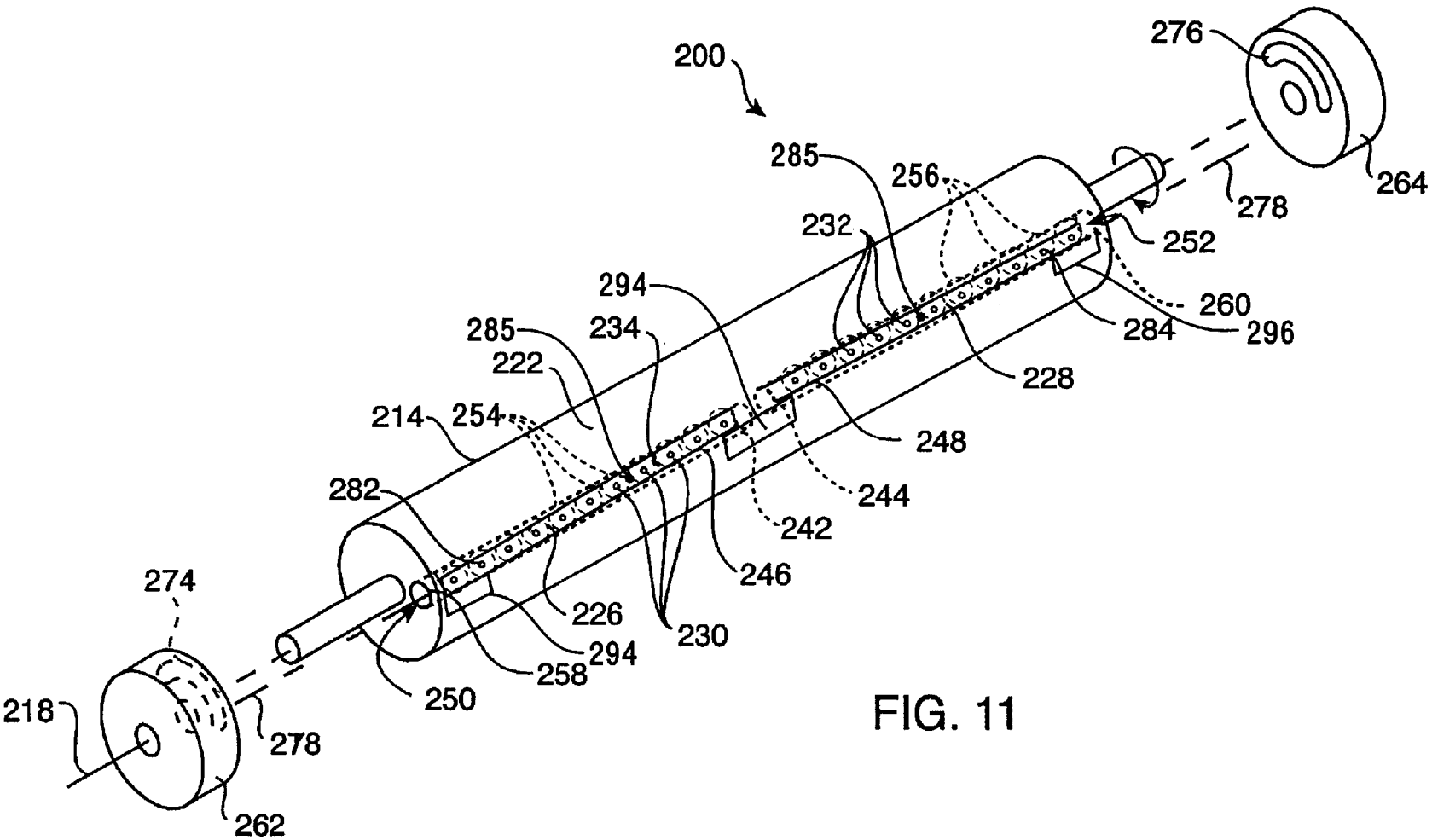
FIG. 11 is a perspective view of a vacuum roll according to a second preferred embodiment of the present invention in which the vacuum roll has two vacuum members.

It should be noted that the present invention as described above and illustrated in FIGS. 1–10 employs one vacuum member at each circumferential position on the roll 114. However, alternative embodiments of the present invention could employ two or more vacuum members in a similar manner. For example, FIG. 11 illustrates an alternative vacuum roll system embodiment 200 of the invention that includes a roll 214, an axis of rotation 218 and a roll surface 222. The vacuum roll system 200 also includes the features described above with respect to the vacuum roll system embodiment 100, but includes two vacuum members, a first vacuum member 226 and a second vacuum member 228. The first and second vacuum members 226, 228 are substantially identical (but can have slightly differing aperture arrangements, if desired) and operate in substantially the same manner described above with respect to vacuum member 126. Like parts of the first vacuum member 226 are indicated by like reference numerals in the two-hundred series. This embodiment can be used in conjunction with long vacuum rolls 214 or in constructions with vacuum rolls 214 that operate very fast and/or with little tolerance for vacuum delay. In these situations, vacuum is typically (but not necessarily) supplied to both ends of the roll 214.

The second vacuum member 228 includes a second plurality of apertures 232 and preferably includes the other features described above in conjunction with the vacuum member 126. The first and second vacuum members 226 and 228 are preferably coupled to the roll 214 in the same way as described above with respect to vacuum member 126. The groove 242 and longitudinal gap 246 can extend the entire length of the roll 214 and receive both the first and second vacuum members 226 and 228. Alternatively, as shown in FIG. 11, first and second grooves 242 and 244 and first and second longitudinal gaps 246 and 248 can be incorporated in the roll 214 with the grooves 242, 244 and gaps 246, 248 being separated in the center of roll 214. The roll 214 could even include more than two vacuum members (not shown) in line and mounted in one or more grooves and gaps with a vacuum valve (not shown) inside the roll to supply the interior vacuum members with vacuum.

First vacuum line 250 and/or first line openings 254 [(not visible in FIG. 11)] can extend the entire length of the roll 214 to provide fluid communication to both the first and second plurality of apertures 230 and 232. Alternatively, as shown in FIG. 11, first and second vacuum lines 250 and 252 and/or first and second line openings 254 and 256 can be incorporated in the roll 214 with the first and second lines 250, 252 and first and second line openings 254, 256 being separated in the center of the roll 214. Regardless of whether a second vacuum line 252 is used, a second vacuum inlet 260 is located at the end of the roll 214 opposite the first vacuum inlet 258.

With reference to the preferred embodiment shown in FIG. 11, a second rotary vacuum valve 264 is coupled to the roll 214 at the end opposite the first rotary vacuum valve 262. Second rotary vacuum valve 264 preferably includes all of the other features described above in conjunction with first rotary vacuum valve 162 and is preferably oriented in mirror-image relation to the first rotary vacuum valve 262. The second rotary vacuum valve 264 is connected to a vacuum source (not shown), or alternatively to a second vacuum source (also not shown), at the second valve inlet 260. The second arcuate groove 276 is positioned for fluid communication with the second vacuum inlet 260.

The operation of vacuum roll system 200 is substantially the same as described in relation to vacuum system 100 except that vacuum is supplied to both ends of roll 214 and propagates from both ends toward the center of roll 214. To alleviate the problem of angular delay, both the first and second vacuum members 226, 228 are movable, and preferably pivotable, with respect to the surface longitudinal axis 278 as described above in relation to the vacuum member 126. The surface longitudinal axis 278 intersects the first or end aperture 282 of the first plurality of apertures 230 at one end of the roll 214 and also intersects a first or end aperture 284 of the second plurality of apertures 232 at the opposite end of the roll 214. The first aperture 284 of the second plurality of apertures 232 is preferably the aperture closest to the second vacuum inlet 260. The first vacuum member 226 can pivot such that the first plurality of apertures 230 is arranged in a line that is skewed with respect to the surface longitudinal axis 278. Likewise, the second vacuum member 228 can pivot such that the second plurality of apertures 232 is arranged in a line that is skewed with respect to the surface longitudinal axis 278.

To compensate for angular delay, both vacuum members 226, 228 are pivoted so that the respective lines defined by the plurality of apertures 230, 232 are skewed in a direction away from the direction of rotation of the roll 214. The apertures nearest the center of the roll 214 will therefore lag behind the first apertures 282, 284.

The first and second vacuum members 226, 228 can be pivoted either manually or automatically, and can be pivoted about a number of possible pivot points 285 as described above with respect to the vacuum member 126. Automaiic pivoting of the first and second vacuum members 226, 228 can be driven by a single positioning device 294, or alternatively can be driven by first and second positioning devices 294 and 296 of the types described above.

In both vacuum roll system embodiments 100, 200, it is possible to have any number of vacuum members 126, 226 and 228 positioned circumferentially around the rolls 114, 214 at any spacing. In a highly preferred embodiment, the vacuum members 126, 226 and 228 are positioned at ninety degree increments about the circumference of the roll 114, 214.

Figure 12:
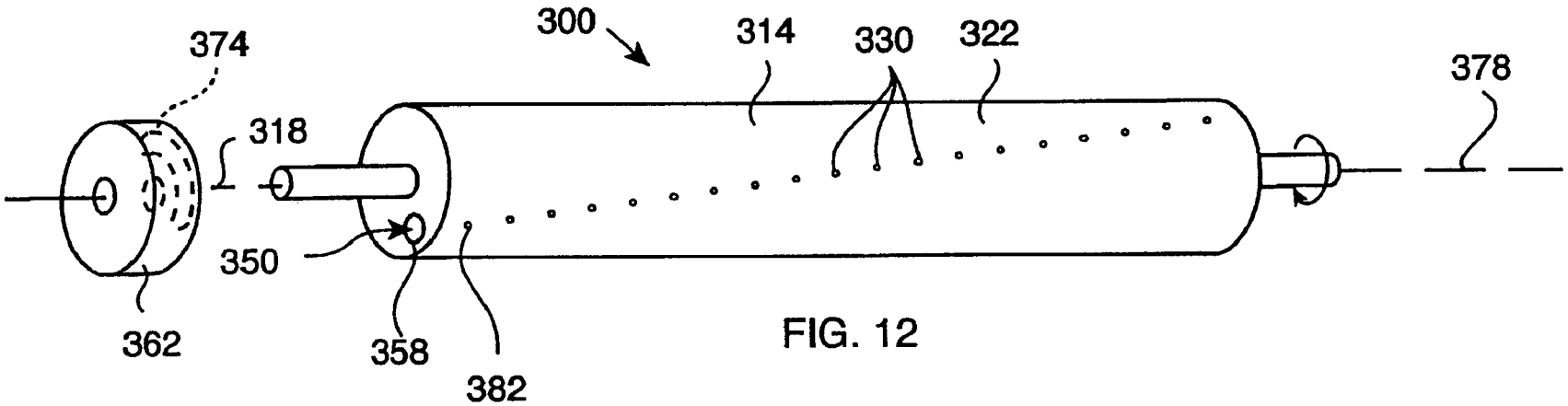
FIG. 12 is a perspective view of a vacuum roll according to a third preferred embodiment of the present invention without a vacuum member.

It should be noted that the present invention and appended claims describe a vacuum roll with one or more vacuum members, but could also be practiced without vacuum members. As seen in FIG. 12, vacuum roll system 300 illustrates yet another embodiment of the invention. With the exception of the vacuum member 126 and features associated therewith, the components and operation of the vacuum roll system 300 are preferably substantially the same as described above with respect to the vacuum roll system 100 of the first preferred embodiment, with like parts indicated by like reference numerals in the three-hundred series. If the direction of rotation and rotational speed for roll 314 are known and will remain substantially constant during normal operation of the vacuum roll system 300, it is possible to eliminate the vacuum members and to locate the plurality of apertures 330 directly in the surface 322 of the roll 314.

The surface longitudinal axis 378 runs longitudinally along the length of the roll 314 and is oriented in a direction substantially parallel to the axis of rotation 318. The surface longitudinal axis 378 preferably intersects an end or first aperture 382 of the plurality of apertures 330, which is preferably the aperture closest to the vacuum inlet 358. The plurality of apertures 330 is arranged in a line that is skewed with respect to the surface longitudinal axis 378. To compensate for angular delay, the plurality of apertures 330 is arranged in a line that is skewed away from the direction of rotation. The specific arrangement of apertures and manner and degree of skew is determined by the operating parameters under which the roll 314 will be used.

Figure 13:
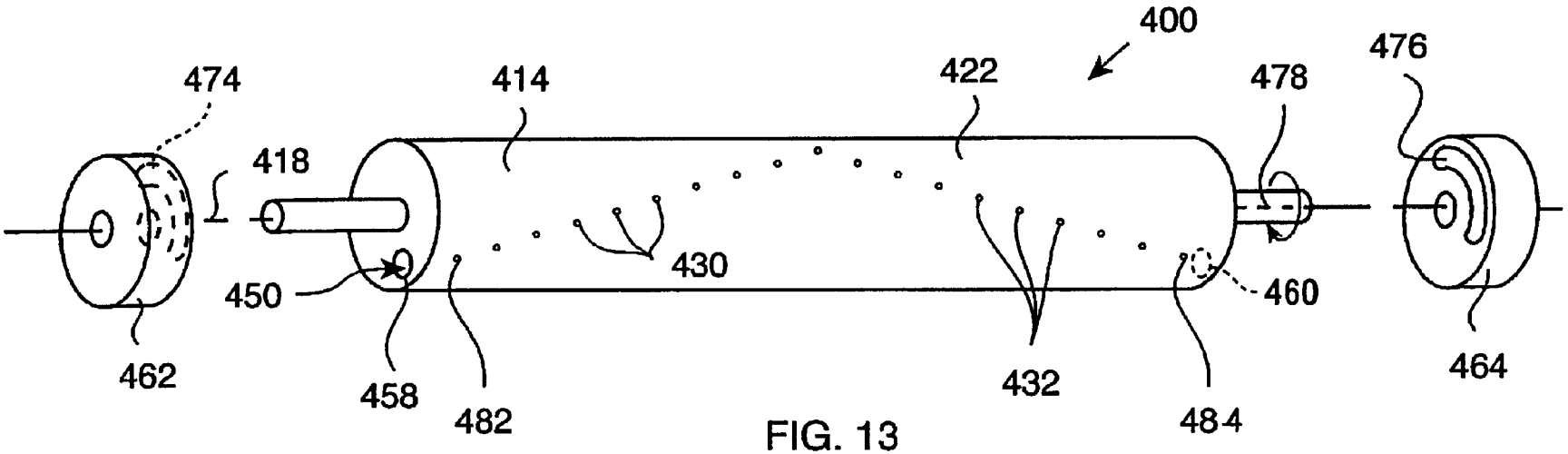
FIG. 13 is a perspective view of a vacuum roll according to a fourth preferred embodiment of the present invention without a vacuum member.

As an alternative to the single plurality of apertures 330 described above with reference to the third preferred embodiment of the present invention, the vacuum roll could have two or more pluralities of apertures at a circumferential position upon the vacuum roll. For example, FIG. 13 illustrates an alternative vacuum roll system embodiment 400 of the invention that includes a roll 414, an axis of rotation 418 and a surface 422. A first and second plurality of apertures 430 and 432 are arranged in the surface 422 of the roll 414. With the exception of the vacuum members 226, 228 and the components associated therewith, the components and operation of the vacuum roll system 400 are preferably substantially the same as described above with respect to the vacuum roll system 200 of the second preferred embodiment. Like parts are indicated by like reference numerals in the four-hundred series. This embodiment can be used in conjunction with long vacuum rolls 414 or in conjunction with vacuum rolls 414 that operate very fast and/or with little tolerance for vacuum delay. In these situations, vacuum is typically (but not necessarily) supplied to both ends of the roll 414.

The surface longitudinal axis 478 runs longitudinally along the length of the roll 414 and is oriented in a direction substantially parallel to the axis of rotation 418. The surface longitudinal axis 478 intersects the first or end aperture 482 of the first plural of apertures 430 at one end of the roll 414 and also intersects a first or end aperture 484 of the second plurality of apertures 432 at the opposite end of the roll 414. The first aperture 484 of the first plurality of apertures 430 is preferably the aperture closest to the first vacuum inlet 458. The first aperture 484 of the second plurality of apertures 432 is preferably the aperture closest to the second vacuum inlet 460. The first plurality of apertures 430 is arranged in a line that is skewed with respect to the surface longitudinal axis 478. Likewise, the second plurality of apertures 432 is arranged in a line that is skewed with respect to the surface longitudinal axis 478. To compensate for angular delay, both lines defined by the plurality of apertures 430, 432 are skewed in a direction away from the direction of rotation of the roll 414. The specific arrangement of apertures and manner and degree of skew is determined by the operating parameters under which the roll 414 will be used.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, the invention could be practiced to include a plurality of interchangeable plates or inserts having different arrangements of apertures therein. As such, it would be possible to use substantially longitudinally straight and rigid inserts having the proper arrangement of apertures to compensate for the angular delay of a particular application. If the application were to change, a different insert could be substituted on the roll. This would eliminate the need for pivoting the vacuum member and permits more flexibility than can be obtained by simply forming the apertures directly in the surface of the roll.

In another example, the first and second vacuum members can pivot in any conceivable manner such as about an element (e.g., a pin, hinge, post, etc.) or can be free-floating (e.g., held in position with magnets) in the groove and pivot with the help of the positioning device. Furthermore, it can be possible to use the vacuum itself as the positioning device such that application of the vacuum to the roll causes the vacuum members to pivot to the appropriate positions.

I claim:

1. A vacuum roll assembly comprising:

a roll having
- an axis of rotation;
- a surface; and
- a surface longitudinal axis oriented in a direction substantially parallel to the axis of rotation;

a vacuum inlet;

a vacuum line in fluid communication with the vacuum inlet and running along the roll;

a vacuum member coupled to the roll and movable with respect to the surface longitudinal axis; and a plurality of apertures defined in the vacuum member, in fluid communication with the vacuum line, and arranged in a line that is skewed with respect to the surface longitudinal axis.

2. The apparatus of claim 1, wherein the roll has a direction of rotation and wherein the vacuum member is skewed away from the direction of rotation.

3. The apparatus of claim 1, wherein the fluid communication between the vacuum inlet and the plurality of apertures is further provided by a rotary vacuum valve.

4. The apparatus of claim 1, wherein the vacuum line is defined at least in part by an elongated chamber in fluid communication with each of the plurality of apertures.

5. The apparatus of claim 1, wherein the vacuum line is defined at least in part by a plurality of openings, each of the plurality of openings being in fluid communication with a respective aperture.

6. The apparatus of claim 1, wherein the vacuum member is pivotable with respect to the surface longitudinal axis.

7. The apparatus of claim 6, wherein the vacuum member is flexible and wraps around the roll when pivoted with respect to the surface longitudinal axis.

8. The apparatus of claim 6, wherein the vacuum member is pivoted manually.

9. The apparatus of claim 6, the apparatus further comprising a positioning device coupled to the vacuum member and a control coupled to the positioning device, wherein the vacuum member is pivoted automatically responsive to roll speed by the positioning device under control of the control.

10. The apparatus of claim 6, wherein the roll includes two opposing ends and the vacuum member pivots substantially about one of the opposing ends.

11. The apparatus of claim 6, wherein the roll includes a center portion and the vacuum member pivots substantially about the center portion.

12. The apparatus of claim 1, wherein the vacuum inlet is a first vacuum inlet, the vacuum line is a first vacuum line, the vacuum member is a first vacuum member, the plurality of holes is a first plurality of holes and the line is a first line, the apparatus further comprising:

a second vacuum inlet;

a second vacuum line in fluid communication with the second vacuum inlet and running along the roll;

a second vacuum member coupled to the roll; and a second plurality of apertures defined in the second vacuum member, in fluid communication with the second vacuum line, and arranged in a second line skewed with respect to the surface longitudinal axis.

13. The apparatus of claim 12, wherein the roll has a direction of rotation and wherein the second line is skewed away from the direction of rotation.

14. The apparatus of claim 12, wherein the fluid communication between the second vacuum inlet and the second plurality of apertures is further provided by a rotary vacuum valve.

15. The apparatus of claim 12, wherein the second vacuum line is defined at least in part by a plurality of openings, each of the plurality of openings being in fluid communication with a respective aperture of the second plurality of apertures.

16. The apparatus of claim 12, wherein the second vacuum line is defined at least in part by a plurality of openings, each of the plurality of openings being in fluid communication with a respective aperture of the second plurality of apertures.

17. The apparatus of claim 12, wherein the first and second vacuum members are movable with respect to the surface longitudinal axis.

18. The apparatus of claim 12, wherein the first and second vacuum members are pivotable with respect to the surface longitudinal axis.

19. The apparatus of claim 18, wherein the first and second vacuum members are flexible and wrap around the roll when pivoted with respect to the surface longitudinal axis.

20. The apparatus of claim 18, wherein the first and second vacuum members are pivoted manually.

21. The method of claim 18, the apparatus further comprising a first positioning device coupled to the first vacuum member and a first control coupled to the first positioning device, and a second positioning device coupled to the second vacuum member and a second control coupled to the second positioning device, wherein the first and second vacuum members are pivoted automatically responsive to roll speed by the first and second positioning devices, respectively, under control of the control.

22. The apparatus of claim 18, wherein the roll includes two opposing ends, the first vacuum member pivots substantially about one end and the second vacuum member pivots substantially about the opposite end.

23. The apparatus of claim 18, wherein each of the first and second vacuum members are pivotable about their centers.

24. A method of producing a vacuum roll having an axis of rotation, a surface, and a surface longitudinal axis oriented in a direction substantially parallel to the axis of rotation, the method comprising the steps of:

forming a first aperture in a vacuum member;

forming a second aperture in the vacuum member;

forming a vacuum line in the vacuum roll to establish fluid communication between the first and second apertures;

coupling the vacuum member to the roll, the first and second apertures defining endpoints of a line that is skewed with respect to the surface longitudinal axis; and pivoting the vacuum member with respect to the surface longitudinal axis.

25. The method of claim 24, wherein the roll has a direction of rotation and wherein the line is skewed away from the direction of rotation.

26. The method of claim 24, wherein the vacuum member is skewed with respect to the surface longitudinal axis.

27. The method of claim 24, wherein the roll has a direction of rotation and wherein the vacuum member is skewed away from the direction of rotation.

28. The method of claim 24, wherein the line is a first line, the method further comprising the step of:

forming a third aperture in the vacuum member, the third aperture being in fluid communication with the first and second apertures via the vacuum line, the second and third apertures defining endpoints of a second line that is skewed with respect to the first line and the surface longitudinal axis.

29. The method of claim 24, wherein the step of pivoting the vacuum member includes wrapping the vacuum member around the roll.

30. The method of claim 24, wherein the step of pivoting is completed manually.

31. The method of claim 24, wherein the step of pivoting is completed automatically, and comprises:

controlling a position of the vacuum member with a positioning device coupled to a control; and automatically changing the position of the vacuum member with the control and positioning device responsive to roll speed change.

32. A vacuum roll assembly comprising:

a roll having an axis of rotation;

a surface; and a surface longitudinal axis oriented in a direction substantially parallel to the axis of rotation;

a vacuum inlet;

a vacuum line in fluid communication with the vacuum inlet and running along the roll;

a vacuum member coupled to the roll; and a plurality of apertures defined in the vacuum member, in fluid communication with the vacuum line, and arranged in a line that is skewed with respect to the surface longitudinal axis, the plurality of apertures positioned with respect to the vacuum line to exert vacuum force only along a line skewed with respect to the surface longitudinal axis.

33. The apparatus of claim 32, wherein the roll has a direction of rotation and wherein the vacuum member is skewed away from the direction of rotation.

34. The apparatus of claim 32, wherein the fluid communication between the vacuum inlet and the plurality of apertures is further provided by a rotary vacuum valve.

35. The apparatus of claim 32, wherein the vacuum line is defined at least in part by an elongated chamber in fluid communication with each of the plurality of apertures.

36. The apparatus of claim 32, wherein the vacuum line is defined at least in part by a plurality of openings, each of the plurality of openings being in fluid communication with a respective aperture.

37. The apparatus of claim 32, wherein the vacuum inlet is a first vacuum inlet, the vacuum line is a first vacuum line, the vacuum member is a first vacuum member, the plurality of apertures is a first plurality of apertures and the line is a first line, the apparatus further comprising:

a second vacuum inlet;

a second vacuum line in fluid communication with the second vacuum inlet and running along the roll;

a second vacuum member coupled to the roll; and a second plurality of apertures defined in the second vacuum member, in fluid communication with the second vacuum line, and arranged in a second line skewed with respect to the surface longitudinal axis.

38. The apparatus of claim 37, wherein the roll has a direction of rotation and wherein the second line is skewed away from the direction of rotation.

39. The apparatus of claim 37, wherein the fluid communication between the second vacuum inlet and the second plurality of apertures is further provided by a rotary vacuum valve.

40. The apparatus of claim 37, wherein the second vacuum line is defined at least in part by an elongated chamber in fluid communication with each of the second plurality of apertures.

41. The apparatus of claim 37, wherein the second vacuum line is defined at least in part by a plurality of openings, each of the plurality of openings being in fluid communication with a respective aperture of the second plurality of apertures.

42. The apparatus of claim 37, wherein the first and second vacuum members are movable with respect to the surface longitudinal axis.

43. The apparatus of claim 37, wherein the first and second vacuum members are pivotable with respect to the surface longitudinal axis.

44. The apparatus of claim 43, wherein the first and second vacuum members are flexible and wrap around the roll when pivoted with respect to the surface longitudinal axis.

45. The apparatus of claim 43, wherein the first and second vacuum members are pivoted manually.

46. The apparatus of claim 43, wherein the first and second vacuum members are pivoted automatically responsive to roll speed.

47. The apparatus of claim 43, wherein the roll includes two opposing ends, the first vacuum member pivots substantially about one end and the second vacuum member pivots substantially about the opposite end.

48. The apparatus of claim 43, wherein each of the first and second vacuum members are pivotable about their centers.

49. A method of producing a vacuum roll having an axis of rotation, a surface, and a surface longitudinal axis oriented in a direction substantially parallel to the axis of rotation, the method comprising the steps of:

forming a first aperture in a vacuum member;

forming a second aperture in the vacuum member;

forming a vacuum line in the vacuum roll to establish fluid communication between the first and second apertures; and coupling the vacuum member to the roll, the first and second apertures defining endpoints of a line that is skewed with respect to the surface longitudinal axis, the first and second apertures positioned with respect to the vacuum line to exert vacuum force only along the line that is skewed with respect to the surface longitudinal axis.

50. The method of claim 49, wherein the roll has a direction of rotation and wherein the line is skewed away from the direction of rotation.

51. The method of claim 49, wherein the vacuum member is skewed with respect to the surface longitudinal axis.

52. The method of claim 49, wherein the roll has a direction of rotation and wherein the vacuum member is skewed away from the direction of rotation.

53. The method of claim 49, wherein the line is a first line, the method further comprising the step of:

forming a third aperture in the vacuum member, the third aperture being in fluid communication with the first and second apertures via the vacuum line, the second and third apertures defining endpoints of a second line that is skewed with respect to the first line and the surface longitudinal axis.

* * * * *